United States Patent [19]

Crites

[11] Patent Number: 4,611,477

[45] Date of Patent: Sep. 16, 1986

[54] TAMPER RESISTANT LOCK BOLT ASSEMBLY

[75] Inventor: Allan B. Crites, Elk Grove Village, Ill.

[73] Assignee: David Arlasky, Northbrook, Ill.

[21] Appl. No.: 627,077

[22] Filed: Jul. 2, 1984

[51] Int. Cl.[4] ..... E05B 63/00

[52] U.S. Cl. ..... 70/416; 70/360; 70/417; 70/418

[58] Field of Search ..... 70/360, 361, 363, 416, 70/417, 418

[56] References Cited

U.S. PATENT DOCUMENTS

| | | | |
|---|---|---|---|
| 3,538,725 | 11/1970 | Guenther et al. | 70/241 |
| 3,921,422 | 11/1975 | Walters | 70/360 |
| 4,083,211 | 4/1978 | Scherbing | 70/363 |
| 4,380,915 | 4/1983 | Kincaid | 70/224 |

*Primary Examiner*—Robert L. Wolfe

*Attorney, Agent, or Firm*—Marshall, O'Toole, Gerstein, Murray & Bicknell

[57] ABSTRACT

A tamper resistant reciprocal cylinder lock comprising mutually engageable structures on the lock sleeve and bolt keeper having the capacity to increase the resistance of the lock sleeve forward portion from disengagement with the lock sleeve inner portion when the lock and keeper mechanism in a locked position are under physical attack.

7 Claims, 3 Drawing Figures

TAMPER RESISTANT LOCK BOLT ASSEMBLY

BACKGROUND

The present invention relates generally to an improved tamper-resistant, reciprocating cylinder lock and lock bolt keeper mechanism. The apparatus of the present invention provides structure for reducing the likelihood of dislodgement of the sleeve from the lock mechanism to thereby expose the bolt to physical attack.

Conventional, non-reciprocating cylinder locks are typically fixedly mounted to a solid surface, secured against any movement other than rotational movement of the lock cylinder upon insertion of the proper key (e.g., a door lock mounted in a mortise). Reciprocating cylinder locks, in contrast, are designed to permit longitudinal movement of the entire lock mechanism as well as key-actuated rotational movement of the lock cylinder. Reciprocating cylinder locks have a variety of common uses, including vending machines, bicycle shackles, and automobile security devices, for example.

A reciprocal cylinder lock is conventionally mounted within a casing having inner and outer ends, the form of which is determined by the particular use of the lock. A longitudinal passage in the casing defines a cylindrical lock chamber and permits insertion of a protective tubular sleeve inside the chamber. The tubular sleeve, which may be composed of one or more metal or molded plastic portions connected by small pins, has inner and outer ends and a cavity or opening therein extending transverse to the axis of the sleeve. The sleeve is mounted for axial movement between a retracted locked position and an extended unlocked position, and the sleeve is normally urged toward its extended position. A bolt is mounted for movement through the sleeve cavity along a linear path transverse to the axis of the sleeve between a retracted, unlocked position and an extended, locked position. The bolt is normally urged toward the extended, locked position.

Also part of the lock mechanism are a bolt keeper for engaging the bolt when the bolt is in its extended position and a rotatable locking shaft within the sleeve having inner and outer ends. The locking shaft includes structure responsive to rotation of the shaft for retracting the bolt from its extended, locked position. The outer ends of both sleeve and lock shaft are designed for insertion of a key.

In an unlocked condition, a portion of the sleeve-encased lock shaft will extend longitudinally outward from the outer end of the casing. The reciprocating cylinder lock can be moved to a locked position by depressing the longitudinally-extending portion of the sleeve-encased shaft until it is flush with the outer end of the casing. This inward axial movement of the lock shaft aligns the spring-biased bolt with a casing cavity adjacent to the keeper. In this position the bolt spring urges the bolt toward the casing cavity, and brings the bolt into engagement with the lock bolt keeper. A major advantage of such reciprocating devices is that no key is required to place the device in a locked position. Several examples of reciprocating cylinder locks include those described in Scherbing, U.S. Pat. No. 4,083,211 and co-owned, co-pending U.S. patent application Ser. No. 466,975 by Shuler, filed Feb. 16, 1983.

It has been found that conventional reciprocating cylinder locks, particularly those in which the spring-biased bolt extends vertically upward from the lock mechanism and in which the sleeve is formed of two parts connected by a short pin, can be defeated by physical attack on the lock mechanism itself. The lock can be broken by forceable disengagement of the two portions forming the sleeve. As one example, the head of a screwdriver can be inserted in the notch of the shaft and sleeve receptive to a key. Twisting of the screwdriver forces rotation of the forwardmost portion of the sleeve, putting enough excessive pressure on the interconnecting pin to break it. When the pin is broken, the front portion of the sleeve is then easily separable from the back portion of the sleeve and can be removed from the lock mechanism. This results in exposure of the bolt, which may then be easily disengaged from the bolt keeper by the flat head of a screwdriver.

A reciprocating cylinder lock is at particular risk when incorporated into a mechanism such as an anti-theft automobile security device. This is because of the frequency with which auto thefts are attempted and the persistency with which a car thief will tamper with an individual anti-theft device.

There exists, therefore, a need in the art of locking mechanisms for a reciprocating cylinder lock having a two-part sleeve construction which is resistant to dislodgement by common forms of physical tampering.

SUMMARY

The apparatus of the present invention provides a lock with improved capacity to resist physical tampering. More particularly, the present invention provides a reciprocating cylinder lock mechanism which can be utilized with effect in a variety of ways. The improved lock mechanism of the present invention is particularly useful in applications wherein the lock is mounted so that the spring-biased bolt extends vertically upward from the lock mechanism through a back portion of the lock sleeve, which is connected to a front sleeve portion.

Modified interconnections on the sleeve and the keeper of the lock mechanism of the present invention cooperate to increase the resistance of the front sleeve portion to disengagement from its connection with the back sleeve portion when in the locked position by physical tampering with the lock mechanism.

The improved reciprocating cylinder lock mechanism comprises a tubular sleeve consisting of a first sleeve portion with a first external diameter having a cavity therein extending transverse to the axis of the sleeve contiguous with a sleeve extension having a second external diameter less than the first diameter. A second sleeve portion overlaps this extension and has a diameter approximately equal to the first external diameter. This two-part sleeve is mounted for axial movement between a retracted locked position and an extended unlocked position, and is normally urged toward the extended position, preferably by means of a spring. Also part of the reciprocal cylinder lock is a bolt mounted for movement through the sleeve cavity along a linear path transverse to the axis of the sleeve, between a retracted, unlocked position and an extended, locked position. The bolt is normally urged toward the extended, locked position, preferably by a spring. A rotatable locking shaft within the sleeve causes retraction of the bolt from its extended, locked position, upon the urging of a spring.

The improvement of the present invention resides particularly in mutually engageable structures on the sleeve and the keeper cooperating to increase the resistance of the second sleeve portion to dislodgement from its association with the first sleeve portion by physical tampering with said lock mechanism when the lock shaft is in its locked position.

More specifically, there are provided two structures which cooperate to effect the tamper resistance of an improved reciprocal cylinder lock mechanism of the present invention. A fixed projection adjacent to the sleeve cavity extends outwardly from the first sleeve portion extension through the overlapping second sleeve portion in a direction parallel to the linear path of the bolt. This fixed projection may desirably be a rigid bar, but preferably is in the form of a rigid pin. The projection is designed to serve two functions in the improved lock mechanism: first, it provides a strong interconnection between the first sleeve portion and the second sleeve portion; and secondly, it cooperates in imparting tamper resistance to the lock.

The tamper resistance structure on the keeper is designed to slideably engage the sleeve projection for axial movement along a linear path parallel to the axis of the sleeve when the sleeve is moved between the retracted and extended positions; and prevents lateral rotational movement of the projection and rotation movement of the sleeve when the sleeve is in said retracted, locked position.

In a preferred embodiment, this slideably engaging and movement preventing structure comprises two parallel flanges depending from a base, the flanges defining a narrow channel therebetween along the linear path parallel to the sleeve axis. The sleeve projection extends into the channel when the lock mechanism is in locked position.

In a preferred embodiment, this slideably engaging and movement preventing structure comprises two parallel flanges depending from a base, the flanges defining a narrow channel therebetween along the linear path parallel to the sleeve axis. The sleeve projection extends into the channel when the lock mechanism is in both its locked and unlocked positions. Any attempt to laterally rotate the sleeve will bring the projection into contact with one of the flanges on the keeper, preventing further movement in that direction. Lateral rotation of the sleeve being thusly prevented, the lock sleeve cannot be disengaged into separate portions and the lock is resistant to such tampering.

The present invention is particularly adaptable for use in an automobile anti-theft device, and may be included in other reciprocating cylinder locks containing additional tamper-resistant features such as those disclosed in Shuler, U.S. application Ser. No. 466,975, referred to above.

The features of this invention which are believed to be novel are set forth with particularity in the appended claims. The invention together with its further objects and advantages thereof, may be best understood, however, by reference to the following description taken in conjunction with the accompanying drawings, in which like reference numerals identify the like elements in several figures.

DETAILED DESCRIPTION

Figure 1:
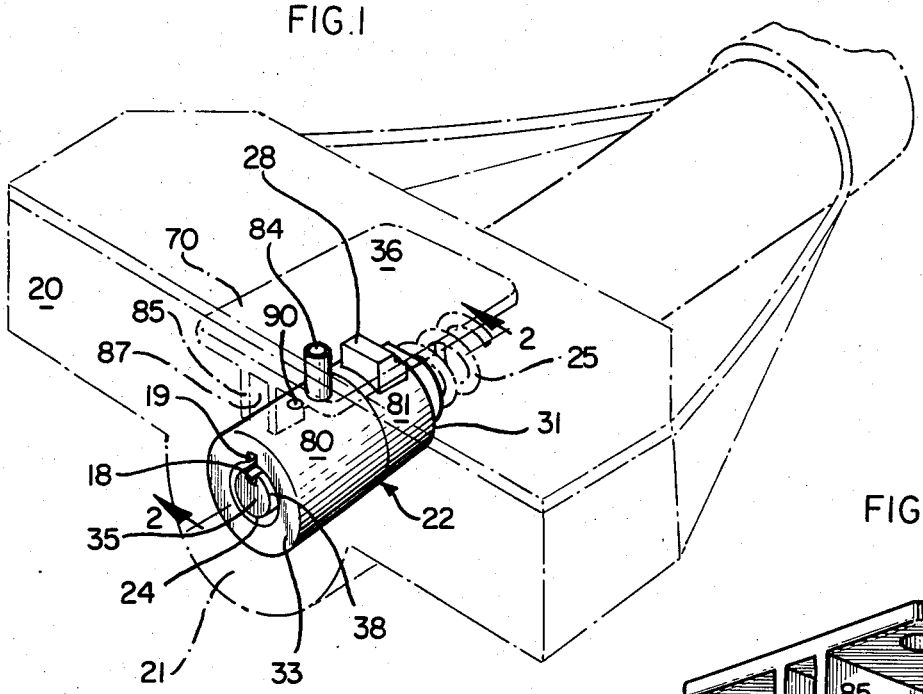
FIG. 1 is a schematic perspective, partially in phantom, illustrating an embodiment of a reciprocating cylinder lock mechanism in accordance with the present invention.

Referring initially to FIG. 1, there is illustrated an improved reciprocating cylinder lock mechanism in accordance with the present invention and which is useful in an automobile anti-theft security device. The mechanism comprises a lock casing 20 designed to fit easily under the dashboard of an automobile. However, the shape of the lock casing is not critical and may be appropriately designed to enable use of the lock of the present invention in other devices, e.g., vending machines.

Within casing 20 is a tubular sleeve 22 having a front sleeve portion 80 with an outer face 33 and a key-receiving notch 19, and a back sleeve portion 81 with inner face 31. Sleeve 22 is mounted for axial movement in casing 20 from an extended, unlocked position to the retracted, locked position shown in FIGS. 1 and 2. Housed within sleeve 22 is a rotatable lock shaft 24 having an outer face 35 and a key-receiving notch 18. A spring 25 (FIG. 1) abuts inner face 31 of back sleeve portion 81 to normally urge the sleeve into the extended, unlocked position. Outer sleeve face 33 and the outer shaft face 35 are designed to accept insertion of a key into notches 19, 18, respectively, which can effect rotational movement of lock shaft 24 to return the mechanism from a locked condition to an unlocked condition. In the unlocked condition, front sleeve portion 80 of sleeve 22 and an outer portion 38 of lock shaft 24 protrude longitudinally outwardly from face 21 of casing 20. Locking can be effected by depressing the protruding portions of sleeve portion 80 and lock shaft 24 against the urging of spring 25 until faces 33, 35 of sleeve 22 and shaft 24, respectively, are flush with casing face 21, as will be described subsequently in more detail.

Figure 2:
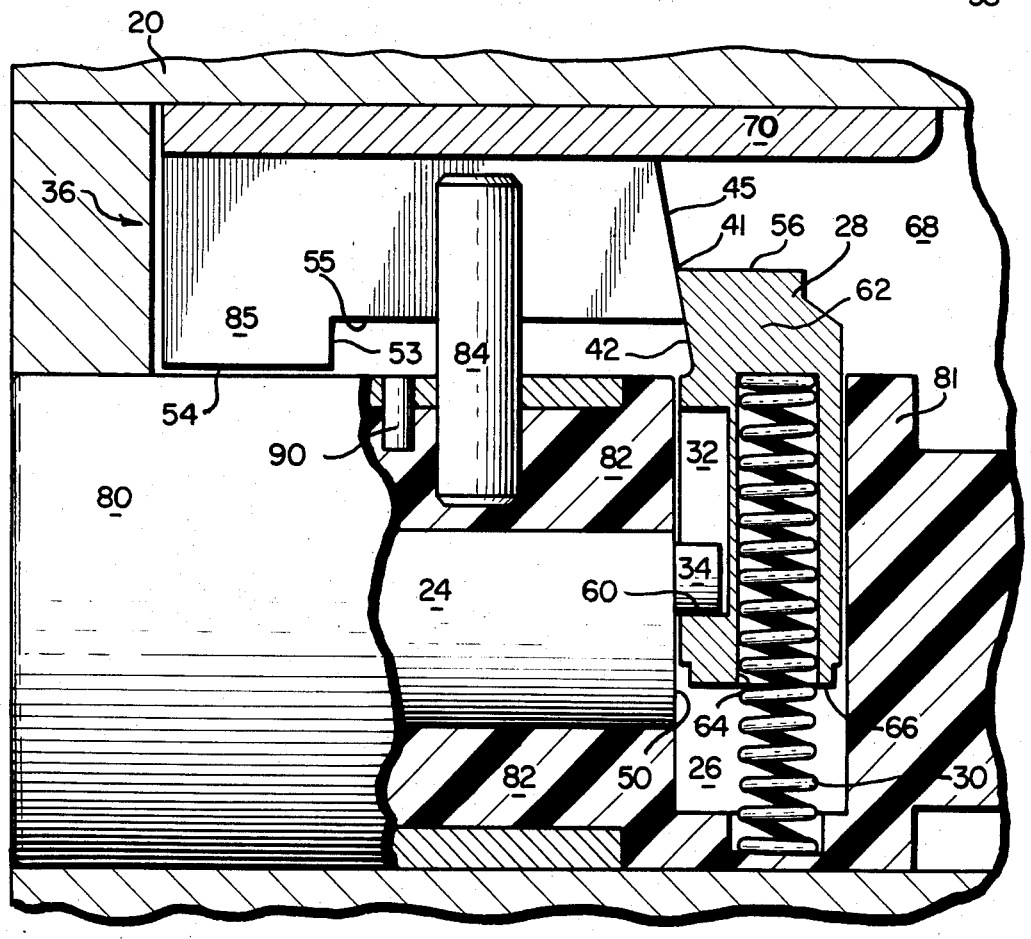
FIG. 2 is an enlarged sectional view, taken along line 2—2 of FIG. 1, showing the bolt and keeper portion of the lock mechanism in locked position.

Referring now to FIG. 2, sleeve portion 81 has an opening or cavity 26 disposed transverse to the axis of sleeve 22 and located close to inner end 50 of lock shaft 24. Within sleeve cavity 26 is a bolt 28 mounted for movement through cavity 26 along a linear path transverse to the axis of sleeve 22, between a retracted, unlocked position and an extended, locked position (shown in FIG. 2). A spring 30 normally urges bolt 28 into the extended position but can be compressed to allow retraction of the bolt to an unlocked position.

Sleeve portion 81 has contiguous therewith a sleeve extension 82 which has an external diameter slightly less than the external diameter of sleeve portion 81, so that the extension 82 may be lapped under sleeve portion 80. Sleeve portion 81 and extension 82 are desirably formed of molded plastic to aid in assembly of the lock mechanism, while sleeve portion 80 is desirably formed of metal. Connecting sleeve portions 80 and 81 is a rigid pin 90 extending through sleeve extension 82 and the overlapping sleeve portion 80 and projecting further above sleeve 22. Also extending through sleeve extension 82 and overlapping sleeve portion 80 is a rigid post 84.

A keeper 36 lies within casing 20 adjacent to and facing tubular sleeve 22. Different portions of keeper 36 engage bolt 28 in its locked and unlocked positions.

Figure 3:
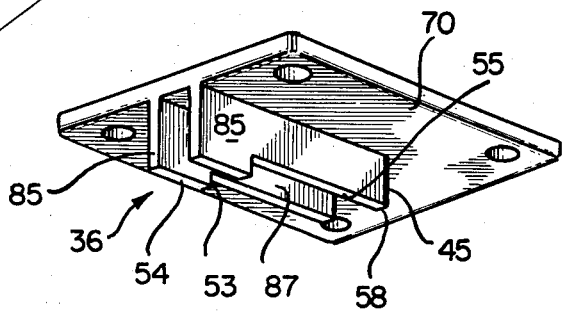
FIG. 3 is a schematic perspective, illustrating an embodiment of a keeper structure according to the present invention.

Referring specifically to FIGS. 2 and 3, keeper 36 comprises a rectangular attachment portion 70 from which two identical flanges 85, 85 project into the casing in the direction of sleeve 22, forming a channel 87 therebetween. Each flange 85 forms a perpendicular shoulder surface 53 between parallel surfaces 54 and 55. Each flange surface 55 terminates at an edge 58 where it joins a surface 45 which terminates at keeper attachment portion 70.

Bolt 28 is a substantially elongated structure having a head portion 62, a shallow lateral recess 32 for cooperation with lock shaft 24, and a longitudinal recess 64 for receiving a spring 30 which urges bolt 28 toward keeper 36. Head portion 62 is designed to project into a cavity 68 in the casing adjacent to the surfaces 45, 45 of keeper flanges 85, 85 to engage keeper 36 in the locked condition. Head portion 62 comprises a surface 42 parallel to keeper flange surfaces 45, 45. Edge 41 of head 62 is formed by the junction of head surface 42 and head surface 56 which is parallel to the keeper flange surfaces 55, 55.

Lateral bolt recess 32 is embedded in the bolt side which faces lock shaft inner end 50 for receiving a lock pin 34 extending from lock shaft inner end 50 and eccentrically disposed with respect to the longitudinal axis of lock shaft 24. Longitudinal bolt recess 64 extends into bolt 28 from bolt surface 66 parallel and spaced apart from bolt head surface 56.

When the lock is in an unlocked condition, front sleeve portion 80 and outer portion 38 of shaft 24, respectively, protrude from casing face 21. Sleeve 22 and shaft 24 are retained within casing 20 against the urging of spring 25 by the engagement of keeper flange shoulder surfaces 53, 53 with edge 41 on the bolt head portion, thereby preventing the sleeve, lock shaft and bolt from being removed from the casing. Post 84 is within channel 87 of keeper 36, so that sleeve 22 is not rotatable. Spring 30 is compressed by the force exerted by keeper flange surfaces 55, 55 on bolt head surface 56, and lock pin 34, which protrudes into bolt recess 32, is spaced above lower side 60 of bolt recess 32.

When sleeve outer face 33 and lock shaft outer face 35 are depressed flush against casing face 21, sleeve 22 moves axially inwardly against the urging of spring 25 until bolt edge 41 clears keeper flanges edges 58, 58. During this inward movement, post 84 travels within channel 87 between keeper flanges 85, 85. Bolt 28 is then urged through sleeve opening 26 by spring 30, until lower side 60 of bolt recess 32 contacts lock pin 34 (the condition illustrated in both FIGS. 1 and 2). Bolt 28 is thereby urged by spring 30 along a linear path through opening 26 in tubular sleeve 22 and into casing cavity 68 and engagement with keeper 36.

To return the lock to its unlocked condition, a key is inserted into outer sleeve face 33 and outer lock shaft face 35. Turning of the key causes lock shaft 24 to rotate approximately 180°. Rotation of lock shaft 24 urges lock pin 34 against bolt recess lower side 60, thereby compressing spring 30 and retracting bolt 28 from its locked position. When bolt edge 41 clears keeper edges 58, 58, spring 25 urges sleeve 22 and shaft 24 toward casing face 21, whereby bolt head surface 56 contacts keeper surfaces 55, 55. Post 84 again travels within channel 87 during the outward movement. Once keeper surfaces 55, 55 restrain spring 30 by contact with bolt surface 56, post 84 remaining between the keeper flanges, lock shaft 24 and lock pin 34 rotate 180° back to their original positions, and the lock is returned to unlocked condition.

When the bolt is in either a locked or unlocked position, the engagement between keeper flanges 85, 85 and post 84 imparts tamper-resistance to the lock mechanism. Mutually engaging post 84 and channel 87 on sleeve portion 80 and keeper 36, respectively, cooperate to increase the resistance of the sleeve portion 80 to disengagement from its connection with sleeve portion 81 by physical tampering with the lock mechanism. The position of a keeper flange lateral to the post holds sleeve 22 firmly in its non-rotatable position within the lock mechanism of the present invention by impeding lateral rotation of sleeve portion 80.

The position of each flange 85, 85 impedes lateral rotation of the sleeve portion 80 in either direction, because as sleeve portion 80 is twisted slightly in one direction, post 84 will meet a flange and be prevented from further movement in that direction. Attempts to twist the sleeve in the opposite direction will cause the post to meet the other flange. Thus, physical tampering with the lock mechanism without a key can be defeated to a considerable extent. When in a locked or unlocked position, sleeve 22 is resistant to any force applied to laterally rotate sleeve portion 80 in an effort to destroy the interconnection between sleeve portion 80 and sleeve portion 81, thereby preventing removal of sleeve portion 80 and easy access to the bolt. This improvement in the lock mechanism therefore enables the lock to defeat a frequently used method of tampering with reciprocating cylinder lock mechanisms.

The foregoing detailed description has been given for clearness of understanding only, and no unnecessary limitations should be understood therefrom as modifications will be obvious to those skilled in the art.

What is claimed is:

1. A reciprocating cylinder lock mechanism comprising:

a tubular sleeve consisting of a first sleeve portion with a first external diameter having a cavity therein extending transverse to the axis of said sleeve contiguous with a sleeve extension having a second external diameter less than said first diameter; and a second sleeve portion which overlaps said extension and has a diameter approximately equal to said first external diameter;

means mounting said sleeve for axial movement between a retracted, locked position and an extended, unlocked position;

means normally urging said sleeve toward said extended position;

a bolt;

means mounting said bolt for movement through said cavity along a linear path transverse to the axis of said sleeve, between a retracted, unlocked position and an extended, locked position;

means normally urging said bolt toward said extended, locked position;

a bolt keeper comprising means for engaging said bolt when the bolt is in its retracted, unlocked position and when the bolt is in its extended, locked position;

a rotatable locking shaft within said sleeve;

means responsive to the rotation of said shaft for retracting said bolt from its extended, locked position; and a fixed projection adjacent to said sleeve cavity and extending outwardly from said first sleeve portion extension through said overlapping second sleeve portion in a direction parallel to the linear path of said bolt; and means on said keeper cooperating with said projection for preventing lateral movement of said projection and rotational movement of said sleeve when said sleeve is in said retracted, locked position to increase the resistance of said second sleeve portion to dislodgement from its association with said first sleeve portion by physical tampering with said lock mechanism.

2. The lock mechanism according to claim 1 wherein said projection comprises a rigid pin.

3. The lock mechanism according to claim 1 wherein said projection comprises a rigid bar.

4. The lock mechanism according to claim 1 wherein said movement preventing means comprising two parallel flanges depending from a base, said flanges defining a narrow channel therebetween along said linear path parallel to the sleeve axis.

5. The lock mechanism according to claim 1 wherein said sleeve urging means comprises a spring.

6. The lock mechanism according to claim 1 wherein said bolt urging means comprises a spring.

7. The lock mechanism according to claim 1 wherein said bolt retracting means comprises an eccentrically positioned lock pin on said shaft.

* * * * *